US007726227B2

(12) United States Patent
Chan

(10) Patent No.: US 7,726,227 B2
(45) Date of Patent: Jun. 1, 2010

(54) BASE FOR A PAPER PUNCH AND METHOD OF FORMING SAME

(75) Inventor: Kwok Ki Stephen Chan, Hong Kong (HK)

(73) Assignee: Lee Tack Plastic & Metal Manufactory, Ltd., New Territories (HK)

( * ) Notice: Subject to any disclaimer, the term of this patent is extended or adjusted under 35 U.S.C. 154(b) by 560 days.

(21) Appl. No.: 11/669,990

(22) Filed: Feb. 1, 2007

(65) Prior Publication Data

US 2008/0184859 A1 Aug. 7, 2008

(51) Int. Cl.
*B26F 1/02* (2006.01)

(52) U.S. Cl. ..... 83/685; 83/698.91

(58) Field of Classification Search ..... 83/684, 83/698.91, 685, 686
See application file for complete search history.

(56) References Cited

U.S. PATENT DOCUMENTS 5,165,315 A * 11/1992 Terada ..... 83/413
5,437,547 A * 8/1995 Holton et al. ..... 425/548
6,089,137 A * 7/2000 Lee ..... 83/621
6,938,542 B1 * 9/2005 Ho et al. ..... 101/31.1
7,281,501 B2 * 10/2007 Leufen et al. ..... 123/41.65
2004/0194281 A1 * 10/2004 Endemann et al. ..... 29/513
2004/0231474 A1 * 11/2004 Bier et al. ..... 83/13
2007/0095191 A1 * 5/2007 Moss et al. ..... 83/870

FOREIGN PATENT DOCUMENTS

EP 0861679 * 9/1998

* cited by examiner

*Primary Examiner*—Stephen Choi
(74) *Attorney, Agent, or Firm*—William J. Sapone; Coleman Sudol Sapone P.C.

(57) ABSTRACT

A method of forming a base (118) for a paper punch (154) is disclosed as including the steps of (a) providing a cast iron core (102) with a wall (104) and a plate (106) with a hole (108); (b) providing two generally U-shaped cast iron plates (110); (c) positioning the plates (110) spaced apart from and on opposite sides of the core (102); and (d) insert-molding the core (102) and plates (106) with a plastics material, e.g. ABS.

11 Claims, 7 Drawing Sheets

FIG. 6
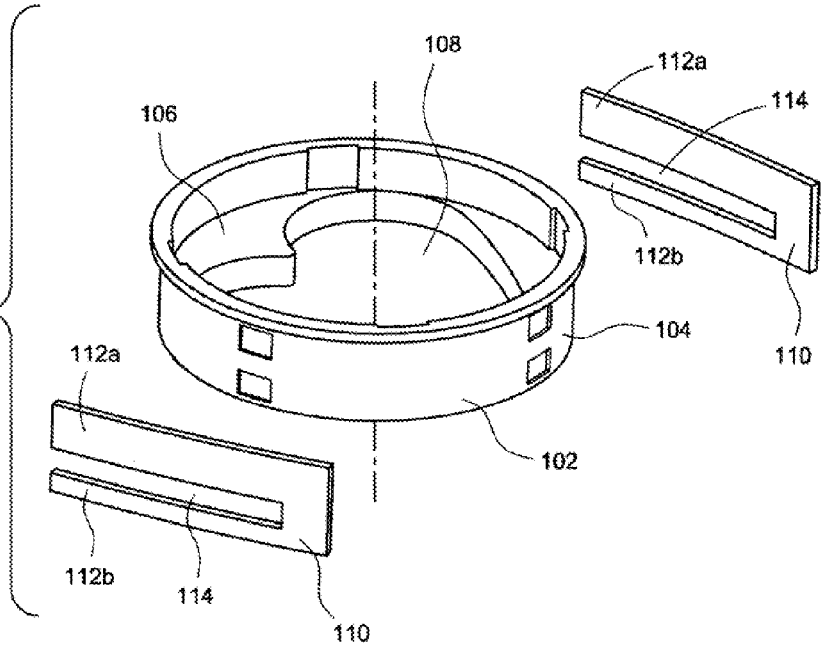
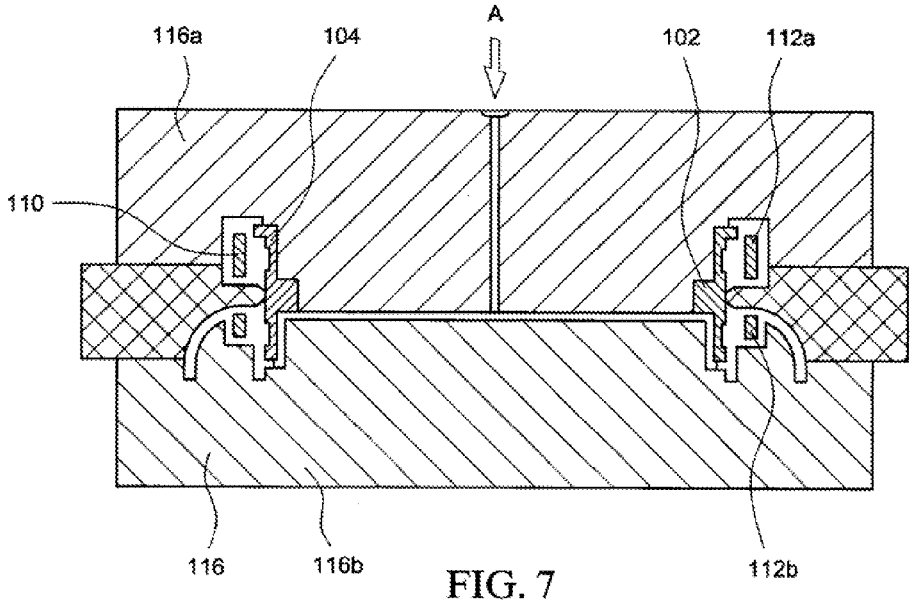
FIG. 7

BASE FOR A PAPER PUNCH AND METHOD OF FORMING SAME

This invention relates to a base for a paper punch and a method of forming such a base and, in particular, such a base for a paper punch suitable for paper crafting purposes.

BACKGROUND OF INVENTION

In the field of paper crafting, pieces of paper or cardboard of various shapes are punched out from sheets of paper or cardboard by paper punches. A conventional paper punch is shown in FIGS. 1 and 2 and generally designated as 10. The paper punch 10 has a operating handle 12 operatively associated with a main body 14. A generally horizontal slot 16 is provided in the main body 14, for insertion of a sheet of paper or cardboard 18. The operating handle 12 may then be pivoted downwardly to move a punch die (see FIG. 4) to punch or cut out a piece of shaped paper or cardboard 18*a* from the piece of paper or cardboard 18, as shown in FIG. 3.

As shown in FIG. 4, the operating handle 12 is pivotable about a point 20 to bear down on a metal punch die 22 to move vertically downward to pass through a slot 24 between an upper jaw 26 and a lower jaw 28 of a metal base 30 to perform the cutting action. Upon release of the downward force, a spring 32 provided between the punch die 22 and the base 30 acts to return the punch die 22 to the upper stable position as shown in FIG. 4.

In a conventional paper punch, the die and the die holder (also called a "base") are made of metal or metal alloy (such as copper, aluminium, silver, zinc or tin) by low pressure die cast, e.g. by injection molding. Although it has been known that the cost of the product may be reduced if at least part of the die or base is made of a plastics material, it has long, been held by people in the field that such may jeopardize proper alignment between the die and the base, in particular during the course of relative movement between the die and the base in the punching action. It is also believed that the strength and rigidity of the base may be compromised if part of it is made of other materials, e.g. a plastics material.

It is thus an object of the present invention to provide a base for a paper punch, a paper punch with such a base, and a method of forming such a base in which at least part of the base is made of a plastics material, while minimizing the aforesaid envisaged shortcomings, or at least to provide a useful alternative to the trade and public.

SUMMARY OF THE INVENTION

According to a first embodiment of the present invention, there is provided a method of forming a base for a paper punch, including the steps of (a) providing a core part with a wall member and a plate with at least one hole; (b) providing at least two generally U-shaped plate members; and (c) insert-moulding at least said core part with a plastics material.

According to a second embodiment of the present invention, there is provided a base for a paper punch, including a body part fixedly engaged with a core part with a wall member and a plate with at least one hole, and two generally U-shaped plate members spaced apart from and on opposite sides of said core part; wherein said core part and plate members are made of a material different from that with which said body part is made.

According to a third embodiment of the present invention, there is provided a paper punch including a die and a base, said base being formed by a method including the steps of (a) providing a core part with a wall member and a plate with at least one hole; (b) providing at least two generally U-shaped plate members, and (c) insert-moulding at least said core part with a plastics material.

According to a fourth embodiment of the present invention, there is provided a paper punch including a die and a base, said base including a body part fixedly engaged with a core part with a wall member and a plate with at least one hole; and two generally U-shaped plate members spaced apart from and on opposite sides of said core part; wherein said core part and plate members are made of a material different from that with which said body part is made.

BRIEF DESCRIPTION OF THE DRAWINGS

A preferred embodiment of the present invention will now be described, by way of example only, with reference to the accompanying drawings, in which:

FIG. 6 shows a core part and two side plates of a base according to a preferred embodiment of the present invention;

FIG. 7 shows schematically the positioning of the core part and side plates shown in FIG. 6 for insert-moulding by a plastics material;

DETAILED DESCRIPTION OF THE PREFERRED EMBODIMENT

Figure 1:
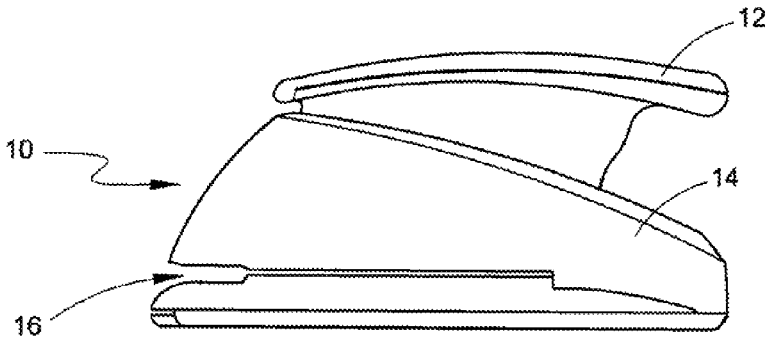
FIG. 1 is a side view of a conventional paper punch.
Figure 2:
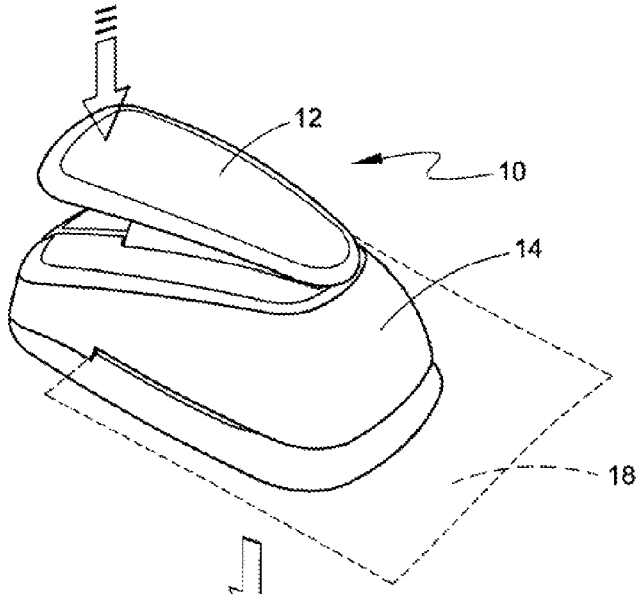
FIG. 2 is a top perspective of the paper punch shown in FIG. 1.
Figure 3:
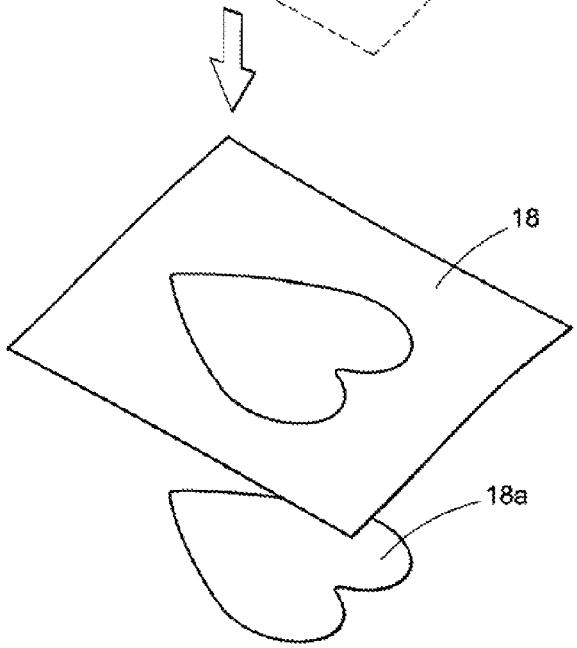
FIG. 3 shows a shaped piece of paper cut out by the paper punch shown in FIG. 2.
Figure 4:
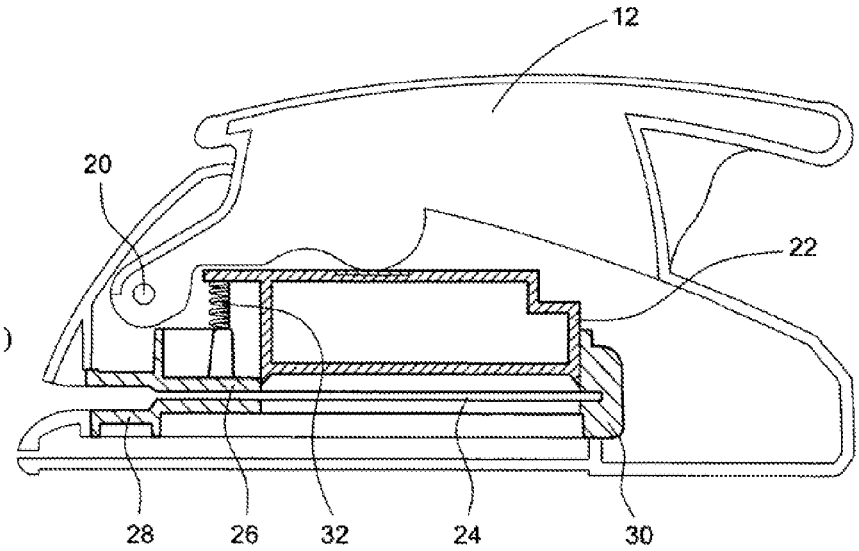
FIG. 4 ( PRIOR ART )
FIG. 4 is a sectional view of the paper punch shown in FIG. 1.
Figure 5:
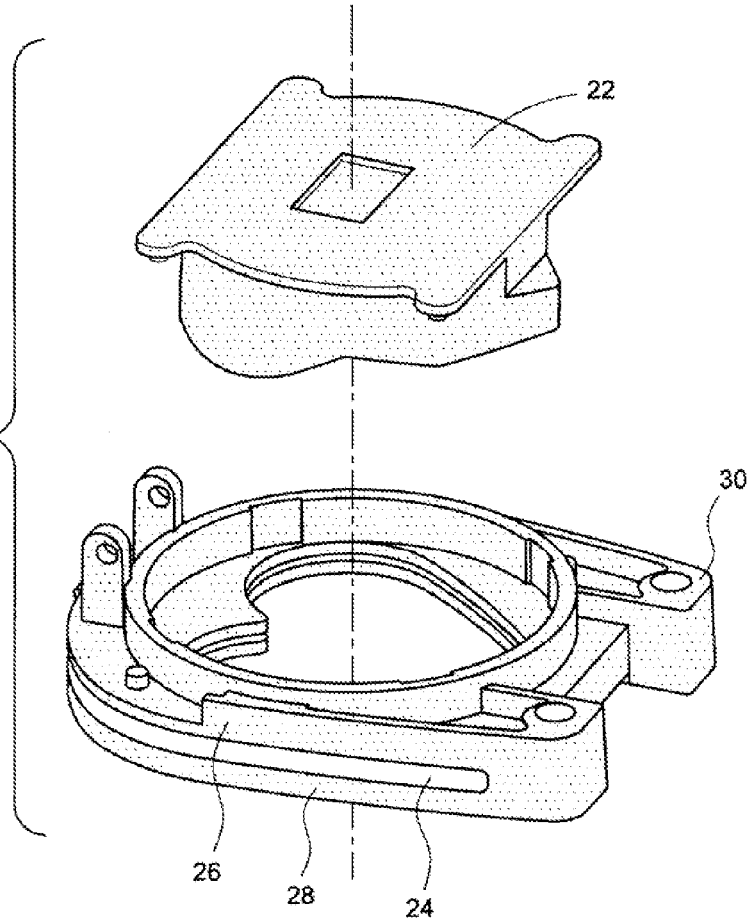
FIG. 5 ( PRIOR ART )
FIG. 5 is an exploded view of the metal punch die and metal base of the paper punch shown in FIG. 1.

According to a first method for forming a base according to the present invention and as shown in FIG. 6, there is firstly formed a cast iron core 102 with a cylindrical wall 104 and a plate 106 in which a shaped through hole 108 is formed. The plate 106 is perpendicular to the wall 104. The shaped 108 is sized and shaped to receive the cutting edge of a corresponding punch die (not shown). The core 102 may be formed of other metals, metal alloys, or some other suitably strong materials.

Two generally U-shaped cast iron plates 110 are also provided. Each U-shaped plate 110 has two arms 112*a*, 112*b* which are spaced apart from each other by a gap 114. The U-shaped plates 110 may be formed of other metals, metal alloys, or some other suitably strong materials.

As shown in FIG. 7, the core 102 and U-shaped plates 110 are positioned within a mould pair 116 formed of an upper mould 116*a* and a lower mould 116*b*. The plates 110 are on opposite sides of and spaced apart from the core 102. A plastics materials, e.g. acrylonitrile-butadiene-styrene terpolymer (ABS), may be injected into the mould in the direction of the arrow A in FIG. 7 to insert-mould the core 102 and U-shaped plates 110.

Figure 8:
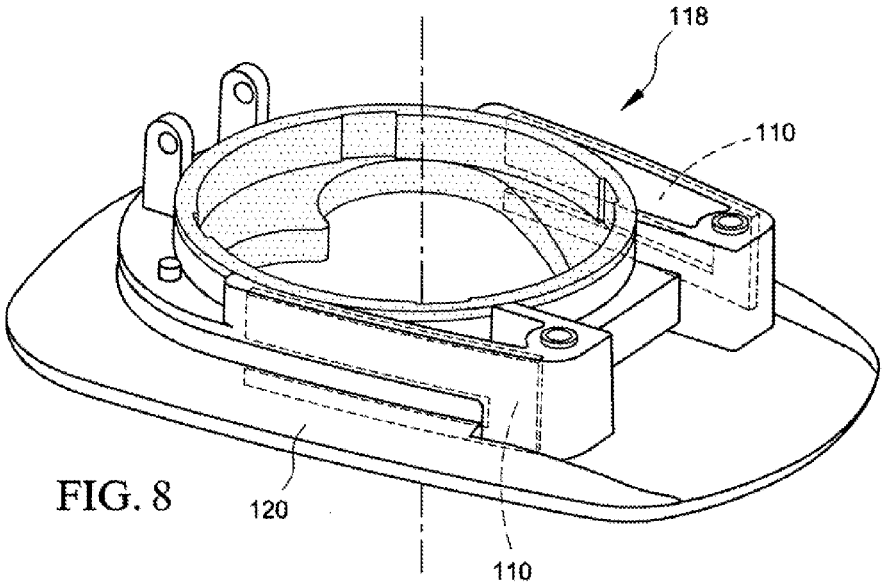
FIG. 8 is a top perspective view of the base just after insert-moulded.
Figure 9:
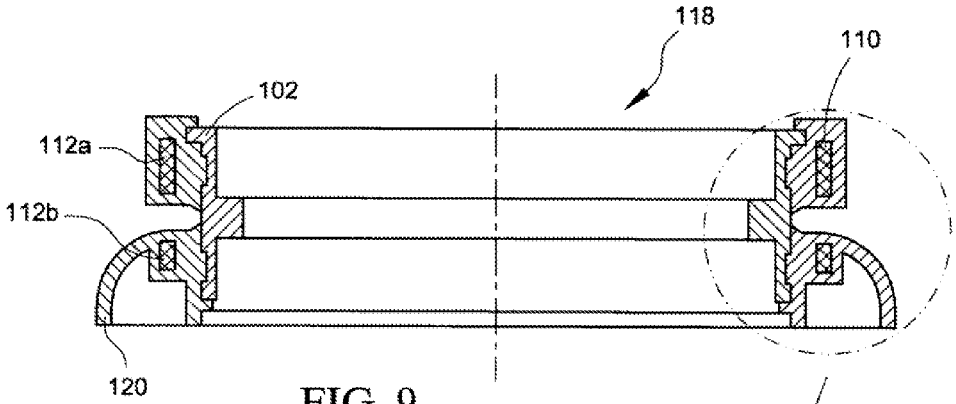
FIG. 9 is a transverse sectional view of the base shown in FIG. 8.
Figure 10:
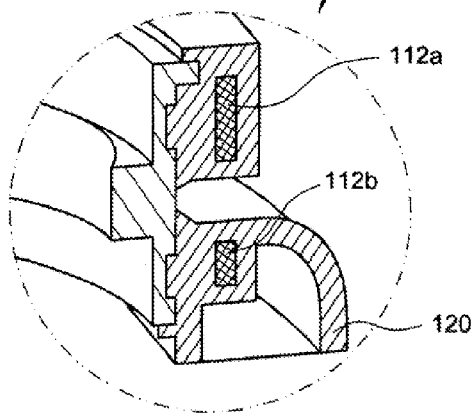
FIG. 10 is an enlarged perspective view of the encircled part in FIG. 9.

A base 118 formed of such a method is shown in FIGS. 8 to 10, in which the U-shaped plates 110, shown in phantom lines, are fully embedded within a body 120. The core 102 is also fixedly engaged with the body 120. It should be understood that although the plates 110 are shown here as fully embedded within the body 120 of the base 118, it is envisaged that the plates 110 may be fixedly secured to the body 120, yet with one of its major surfaces exposed to the outside environment.

Figure 11:
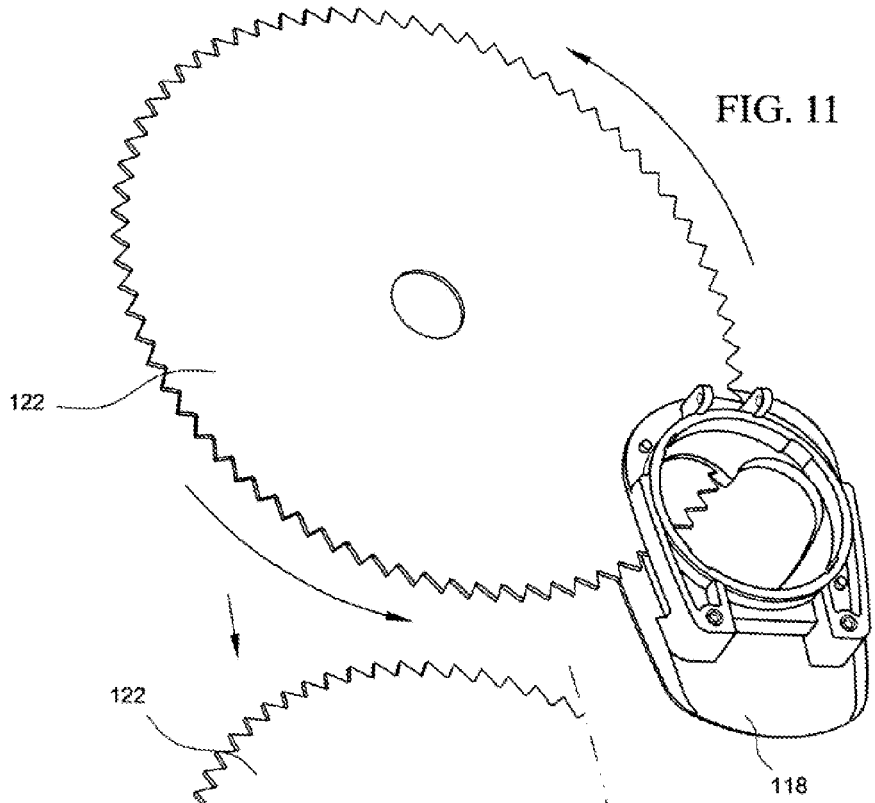
FIGS. 11 to 12 show cutting of the base shown in FIG. 8 to form a slot.
Figure 12:
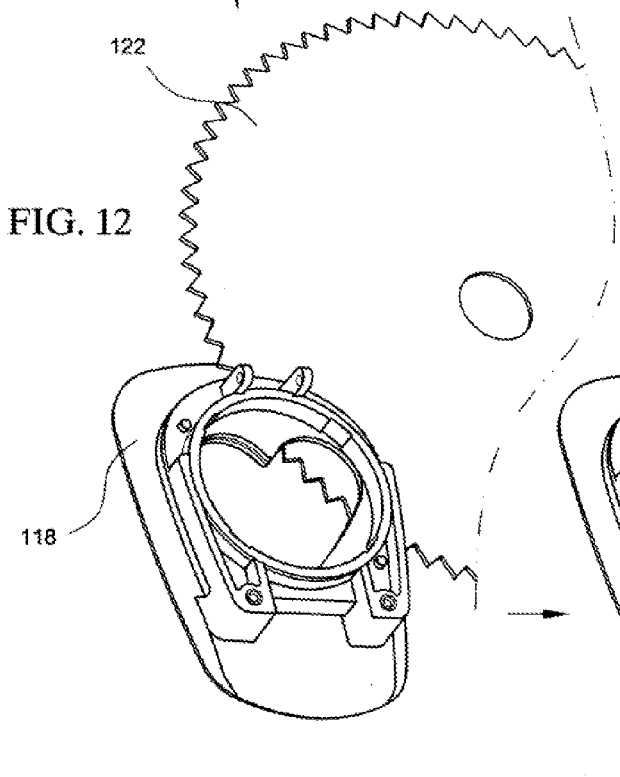
Figure 13:
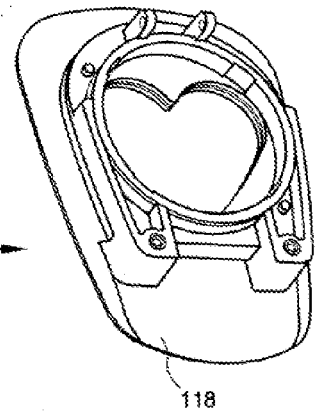
FIG. 13 is a perspective view of the base after cutting.
Figure 14:
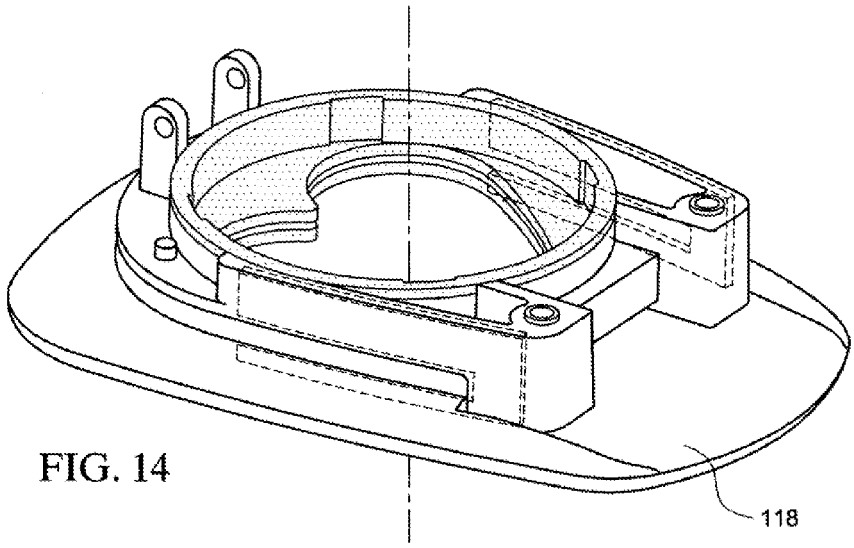
FIG. 14 is a further perspective view of the base after cutting.
Figure 15:
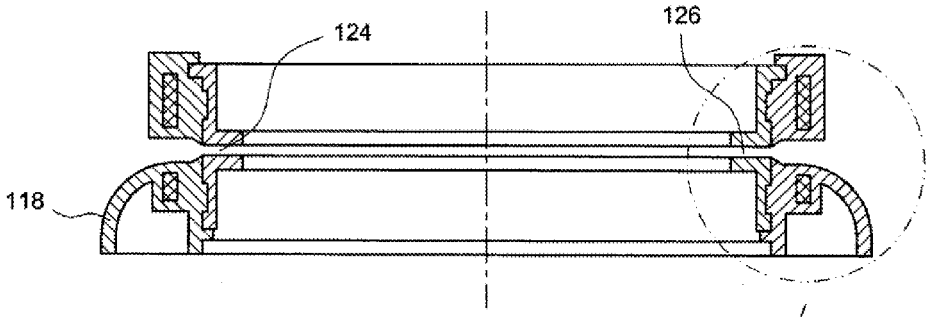
FIG. 15 is a transverse sectional view of the base shown in FIG. 14.
Figure 16:
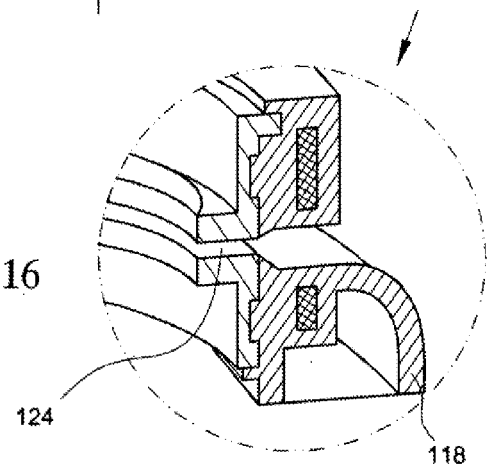
FIG. 16 is an enlarged perspective view of the encircled part in FIG. 15.

As shown in FIGS. 11 to 13, in order to allow the base 118 to function, the wall 104 of the core 102 is cut by a circular cutter 122 to form a slot 124 (see FIGS. 14 to 16) which forms, with the gaps 114 of the U-shaped plates 110, a common opening 126 allowing insertion of a piece of paper or cardboard for cutting purposes.

Figure 17:
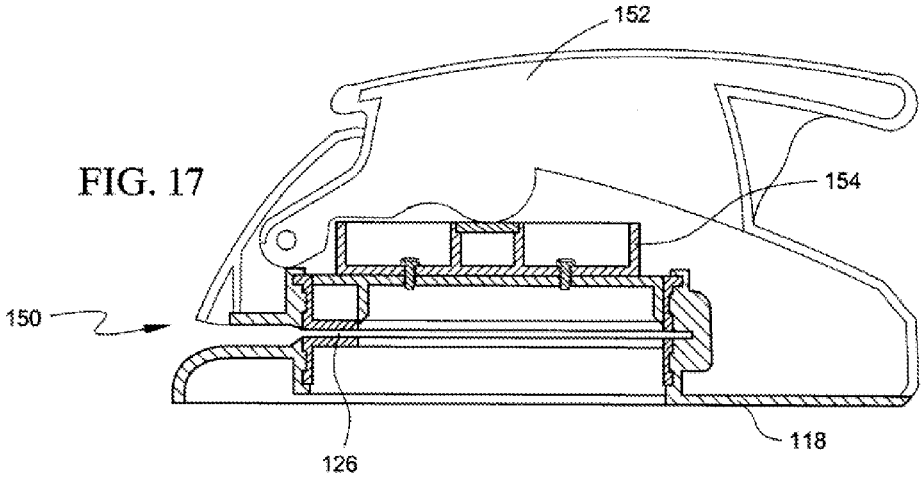
FIG. 17 is a sectional view of a paper punch incorporating the base shown in FIG. 14.
Figure 18:
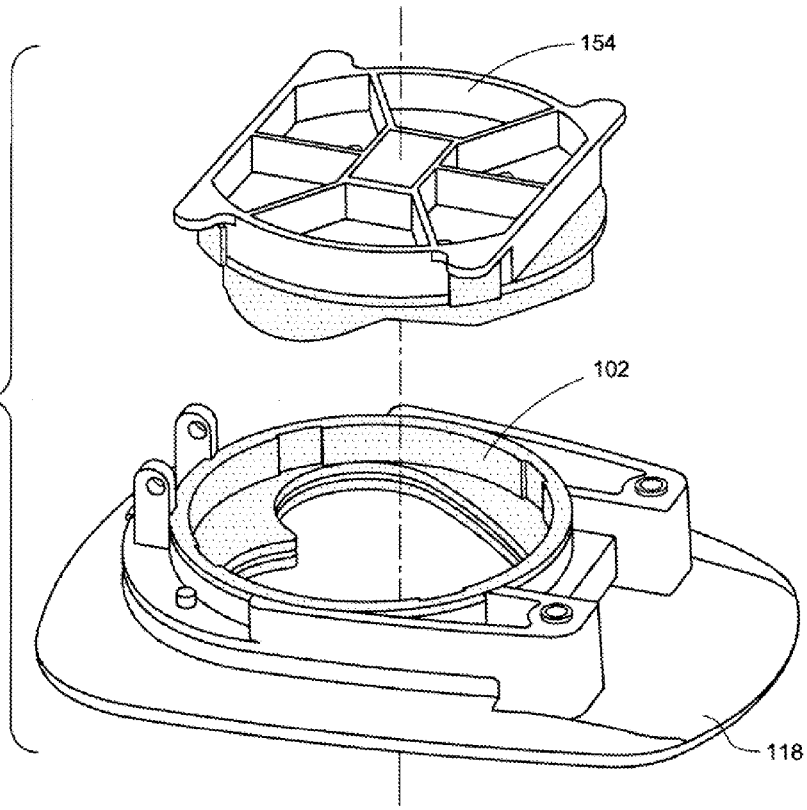
FIG. 18 is an exploded perspective view of a punch die and the base shown in FIG. 14.

A paper punch incorporating the base 118 formed according to the method discussed above is shown in FIG. 17 and generally designated as 150. The paper punch 150 has an operating handle 152 which is pivotable to bear on a punch die 154 to cause the punch die 154 to pass through the common opening 126 formed of the slot 124 and the gaps 114 of the U-shaped plates 110 of the base 118.

It is clear from the foregoing discussion that as part of the base 118 is formed of a plastics material, the cost of production is reduced, without compromising the strength and integrity of the base 118. The U-shaped plates 110 provide support and strength to the base 118, and prevent deformation of the base 118, in particular during the punching action.

According to an alternative method, the core 102 and the U-shaped plates 110 are formed integrally with each other of the same material (e.g. cast iron) simultaneously. They are thus fixedly engaged with each other when formed. The core 102 and the U-shaped plates 110 are then placed within the mould pair 116 for carrying out the insert-moulding process to form the base 118.

According to a further alternative method, only the core 102 is placed within the mould pair 116 for insert-moulding. After moulding, the two U-shaped plates 110 are at least partly received with a respective recess on a respective side of the base 118 and fixedly engaged therewith by interference fit (also called "press fit").

It should be understood that the above only illustrates examples whereby the present invention may be carried out, and that various modifications and/or alterations may be made thereto without departing from the spirit of the invention.

It should also be understood that certain features of the invention, which are, for clarity, described in the context of separate embodiments, may also be provided in combination in a single embodiment. Conversely, various features of the invention which are, for brevity, described in the context of a single embodiment, may also be provided or separately or in any suitable sub-combination.

The invention claimed is:

1. A base for a paper punch, including:

a body part fixedly engaged with a core part having a wall member and a plate with at least one hole; and two generally U-shaped plate members spaced apart from each other and located on opposite sides of said core part, each said plate member being secured to said body part and having two arms separated by a gap, said body part having a slot, said slot of said body part located in correspondence to the gaps of said plate members to form a common opening for receiving therein a niece of material for cutting;

wherein said core part and plate members are made of a material different from that with which said body part is made.

2. A base according to claim 1 wherein said body part is made of a plastics material.

3. A base according to claim 2 wherein said plastics material is acrylonitrile-butadiene-styrene terpolymer.

4. A base according to claim 2 wherein said U-shaped plate members are fully embedded within said plastics material.

5. A base according to claim 2 wherein said U-shaped plate members are partly embedded within said plastics material.

6. A base according to claim 1 wherein said core part is made of a metal or metal alloy.

7. A base according to claim 6 wherein said core part is made of cast iron.

8. A base according to claim 1 wherein said U-shaped plate members are made of a metal or metal alloy.

9. A base according to claim 8 wherein said U-shaped plate members are made of cast iron.

10. A base according to claim 1 wherein said core part is fully contained within said body part.

11. A paper punch including a die and a base according to claim 1.

* * * * *